US007578265B2

(12) United States Patent
Albrecht

(10) Patent No.: US 7,578,265 B2
(45) Date of Patent: Aug. 25, 2009

(54) MULTIPLE PASS ECONOMIZER AND METHOD FOR SCR TEMPERATURE CONTROL

(75) Inventor: Melvin J. Albrecht, Homeworth, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 520 days.

(21) Appl. No.: 11/430,761

(22) Filed: May 9, 2006

(65) Prior Publication Data

US 2007/0261646 A1 Nov. 15, 2007

(51) Int. Cl.
*F22G 1/02* (2006.01)

(52) U.S. Cl. ..... 122/467; 122/470; 122/482

(58) Field of Classification Search ..... 122/6, 122/135.1, 1 C, 4 D, 412, 406.1–406.3, 451 R, 122/451 S, 467, 468, 479.2–479.6, 155.1, 122/159, 166.2

See application file for complete search history.

(56) References Cited

U.S. PATENT DOCUMENTS 4,160,009 A 7/1979 Hamabe
5,419,285 A * 5/1995 Gurevich et al. ..... 122/406.1
5,555,849 A 9/1996 Wiechard et al.
5,775,266 A 7/1998 Ziegler
5,911,956 A 6/1999 Viel Lamare et al.
6,092,490 A * 7/2000 Bairley et al. ..... 122/7 R
6,372,187 B1 * 4/2002 Madden et al. ..... 422/171
6,609,483 B1 8/2003 Albrecht et al.
7,021,248 B2 * 4/2006 McNertney et al. ..... 122/7 R

OTHER PUBLICATIONS

Chapter 34 of STEAM/its generation and use, 41st Ed., Kitto and Stultz, Eds., Copyright 2005, The Babcock & Wilcox Company, Barberton, Ohio, USA, pp. 34-1 through 34-15.

Nischt et al., "Recent SCR Retrofit Experience on Coal-Fired Boilers," Power-Gen International 1999, Nov. 30-Dec. 2, 1999, New Orleans, LA, Fig. 4, pp. 1-11.

* cited by examiner

*Primary Examiner*—Steven B McAllister
*Assistant Examiner*—Robert E Thomas
(74) *Attorney, Agent, or Firm*—Eric Marich

(57) ABSTRACT

A gas temperature control system for maintaining a desired economizer outlet gas temperature across a range of boiler loads comprises a plurality of tubular configurations having surfaces that are in contact with the flue gas. Each tubular configuration, preferably, comprises a plurality of serpentine or stringer tubes arranged horizontally or vertically back and forth within the economizer, and each tubular configuration having a separate feedwater inlet. Heat transfer from the flue gas is accomplished by controlling the feedwater flow rates through the tubular configurations. In a temperature control system having two tubular configurations, the overall heat transfer capacity of the economizer may be reduced to maintain the desired economizer outlet gas temperature during low boiler loads by reducing feedwater flow through one tubular configuration and by overflowing the other tubular configuration, such that total flow of feedwater through the economizer is maintained substantially constant.

29 Claims, 9 Drawing Sheets

MULTIPLE PASS ECONOMIZER AND METHOD FOR SCR TEMPERATURE CONTROL

FIELD AND BACKGROUND OF THE INVENTION

The present invention relates generally to the field of Selective Catalyst Reactor (SCR) temperature control and in particular to a system and method for maintaining the combustion or flue gas entering the SCR system at or above the optimal catalytic reaction temperature, even when operating the boiler at reduced loads.

In operating a boiler with a Selective Catalyst Reactor (SCR) system, the effectiveness of the SCR is dependant upon the flue gas temperature entering the catalyst reactor. Most can operate within a temperature range of about 450 degrees F. to about 840 degrees F. Optimum performance may typically occur between about 570 degrees F. to about 750 degrees F. Typically, the desired gas temperature entering the SCR is about 580 degrees F. or greater. At a temperature of about 580 degrees F., the reaction of ammonia with NOx is optimized and the amount of the ammonia needed for the catalytic reaction is minimized. Therefore, for economic reasons the desired gas temperature entering the catalyst reactor should be maintained within the optimum temperature range of about 570 degrees F. to about 750 degrees F. at all loads.

However, as boiler load varies, the boiler exit gas temperature will drop below the optimal temperature of about 580 degrees F. To increase the gas temperature to about 580 degrees F., current practice has been to use an economizer gas bypass. The economizer gas bypass is used to mix the hotter gases upstream of the economizer with the cooler gas that leaves the economizer. By controlling the amount gas through the bypass system, a boiler exit flue gas temperature of about 580 degrees F. can be maintained at lower boiler loads.

With this approach, static mixing devices, pressure reducing vanes/plates and thermal mixing devices are required to make the different temperature flue gases mix before the gas mixture reaches the inlet of the catalytic reactor. In most applications, obtaining the strict mixing requirements for flow, temperature and the mixing of the ammonia before the catalyst reactor is often difficult.

In another approach to dealing with decreasing flue gas temperature entering a SCR reactor at reduced boiler loads, an economizer was fitted with a feedwater bypass to partially divert the feedwater away from the economizer in order to maintain the flue gas temperature.

Additional details of SCR systems for $NO_x$ removal are provided in Chapter 34 of *Steam/its generation and use,* 41$^{st}$ Edition, Kitto and Stultz, Eds., Copyright© 2005, The Babcock & Wilcox Company, the text of which is hereby incorporated by reference as though fully set forth herein. Flue gas temperature control using conventional economizers are described in U.S. Pat. Nos. 7,021,248 to McNertney, Jr. et al. and 6,609,483 to Albrecht et al., the texts of which are hereby incorporated by reference as though fully set forth herein.

SUMMARY OF THE INVENTION

It is an object of the present invention to provide a system and method for increasing the outlet temperature of flue gas passing through the economizer by reducing the water flow in selected tubes and/or sections of the economizer without the need to divert feedwater away from the economizer. When these selected tubes or sections are reduced in flow, the remaining sections or tubes in the economizer are overflowed so that the total flow is maintained through the economizer. To increase the economizer gas outlet temperature, a certain percentage of the tubes in the economizer will have their heat transfer reduced by decreasing the flow through these tubes. The increase in water flow in the remaining tubes has a minimal effect on the heat transfer of the remaining tubes, resulting in an overall decrease in the total gas side heat transfer of the economizer and as a result increases the gas outlet temperature from the economizer.

It is another object of the present invention to provide a system and a method for maintaining a desired economizer outlet gas temperature across a range of boiler loads by providing two or more sections or compartments of liquid-cooled heat transfer surfaces or tubes in the flow path of the flue gas, wherein the flow rate of each section or compartment is controlled independently of the other sections or compartments, determining the flow rate that is required in each section or compartment in order to produce a combined/overall heat transfer capacity sufficient to maintain the desired economizer outlet gas temperature, and adjusting of the flow rate of each section or compartment of the economizer.

In one aspect, the system is configured to maintain the flue gas entering a catalytic reactor within a desired temperature range that will promote optimal catalytic reaction, irrespective of the boiler load. Preferably, the flue gas temperature is maintained within a range of about 570 degrees F. to about 750 degrees F., preferably about 580 degrees F. In a normal boiler application, the water side of the economizer is used to cool the flue gas that flows over the surface that is installed in the boiler. The system of the present invention separates the heat transfer surfaces of the economizer to increase the outlet temperature of the flue gases to the desired temperature of about 570 degrees F. to about 750 degrees F., preferably, 580 degrees F. at lower boiler loads. This is accomplished by selectively changing the flow rates through different portions of the economizer. By determining the proper amounts and locations of the heating surface, the desired economizer outlet gas temperature can be maintained within the desired temperature range or at a desired temperature across the desired steam generator load range through the control of the flow rates of water through the different sections of the economizer.

It is a further object of the present invention to provide a system for maintaining a flue or combustion gas stream being directed into downstream device such as an SCR assembly within a desired temperature range or at a desired (e.g., optimal) temperature comprising: an economizer located upstream of and in fluid communication with the SCR assembly, wherein the economizer comprises at least two tubular configurations having different heat transfer characteristics, disposed in a cross and or counter-current heat exchange relationship with the flow path of the gas stream generated by a boiler and having a flue inlet and a flue outlet, the boiler being located upstream of and in fluid communication with the economizer, each tubular configuration comprises a feedwater inlet and a feedwater outlet, the outlet of both tubular configurations being attached to an outlet header and the inlet of each tubular configuration being attached to a separate inlet header, and a control system configured to independently control the flow of feedwater through each tubular configuration while maintaining a substantially constant total flow of feedwater through the economizer, the flow of feedwater through each tubular configuration is adjusted in a manner that transfers an appropriate amount of heat from the gas stream to maintain the gas stream at the desired optimal temperature.

It is a further object of the present invention to provide a method of maintaining a gas stream being directed into a downstream device such as an SCR assembly within a desired temperature range or at a desired (e.g., optimal) temperature, the SCR assembly being located downstream of and in fluid communication with an economizer, the method comprising disposing, within the economizer, at least two tubular configurations in a cross and or counter-current heat exchange relationship with the flow path of the gas stream, the economizer having a flue inlet and a flue outlet, each tubular configuration comprises a feed water inlet and a feed water outlet, the outlet of both tubular configurations being attached to an outlet header and the inlet of each tubular configuration being attached to a separate inlet header, monitoring the gas temperature at the flue inlet or flue outlet, the feedwater temperature at the feedwater inlet and outlet, and the flow of feedwater through the economizer, controlling the flow of feedwater conveyed through each tubular configuration, based on the measured temperatures and flow, to provide the tubular configurations with a combined heat transfer capacity that is effective to maintain the gas temperature at the desired level, wherein the heat transfer capacity of the tubular configurations is decreased by increasing the flow of feedwater through at least one of the tubular configurations and by reducing the flow of feedwater through the other tubular configurations.

While the present invention is particularly suited to maintaining a desired flue gas temperature entering a downstream SCR device, it will be appreciated that the invention may be used to maintain a desired gas temperature which may required by other types of downstream devices, and for other purposes. One type of downstream device could be an air heater which typically uses the heat in the flue gas leaving the steam generator to heat the incoming air for combustion. In some cases it is desirable to control the flue gas temperature entering the air heater within a desired range or at a desired temperature above the acid dew point temperature, such as during low load operation, to reduce the possibility of condensation occurring which could form acidic compounds which could lead to corrosion of the air heater. Other types of downstream devices include various types of pollution control equipment; e.g., particulate removal devices such as electrostatic precipitators or fabric filters, and flue gas desulfurization devices such as wet or dry flue gas desulfurization equipment.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
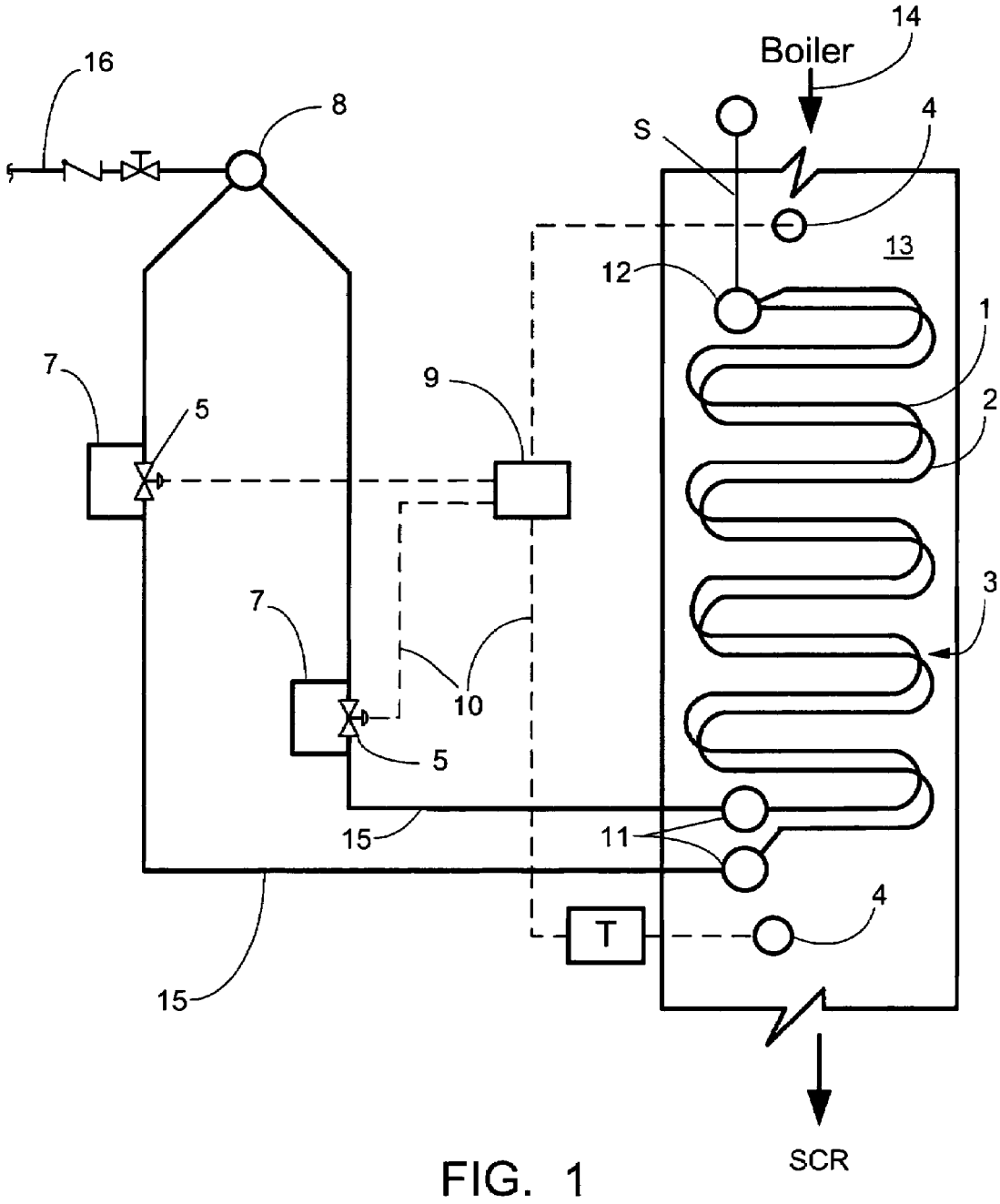
FIG. 1 is a schematic of a gas temperature control system according to a first embodiment of the present invention.

Referring now to the drawings, in which like reference numerals are used to refer to the same or functionally similar elements, FIG. 1 shows an economizer 3 for receiving flue gas generated by a boiler (not shown), located upstream of and in fluid communication with the economizer 3. As used in the present application and as is known to those skilled in the art, the term boiler is used herein to broadly refer to apparatus used for generating steam and may include both drum-type boilers and those of the once-through type. For a general description of such types of boilers or steam generators, the reader is referred to the aforementioned STEAM 41$^{st}$ reference, particularly the Introduction and Selected color plates, and Chapters 19, 20, and 26, the text of which is hereby incorporated by reference as though fully set forth herein. The economizer 3 includes a flue inlet and a flue outlet, and is located in a convection pass 13 upstream of and in fluid communication with a Selective Catalytic Reactor (SCR) assembly (not shown). Within the economizer 3, there is arranged two or more tubular configurations 1, 2 for providing modular heat transfer surfaces for recovery or extraction of heat from the flue gas. The tubular configurations 1, 2 are preferably disposed in a cross and or counter-current heat exchange relationship with respect to the flow path 14 of the flue gas. It is also contemplated that the tubular configurations may be disposed in a cross and or co-current heat exchange relationship with the flow path 14 of the flue gas.

Each tubular configuration 1, 2 is attached on one end to an inlet header 11, and on the other end, the tubular configurations 1, 2 may each be connected to a separate (not shown) or to a common outlet header 12, which is supported by stringer tubes S. A feedwater line 15 is connected to each inlet header 11, and on each feedwater line 15 there is preferably provided a control valve 5. Each feedwater line 15 may also include a bypass line 7 installed around the control valve 5 for cleaning or flushing the feedwater lines 15 or the tubular configurations 1, 2, or for performing maintenance on the control valve 5. The feedwater lines 15 are connected to the main feedwater line 16 through a distributor 8. While individual sets of control valve 5 and bypass valve 7 may be installed on each feedwater line 15, it will be appreciated that a single control valve 5, bypass line 7 "pair" which is installed in only one feedwater line 15 may be required. The provision of a control valve 5, bypass line 7 pair on all feedwater lines 15 ensures optimum control of the flow through each of the tubular configurations 1, 2, and may be particularly useful at lower boiler loads, but this degree of sophistication and control may not be required in all applications.

In one embodiment, each tubular configuration 1, 2 comprises a plurality of serpentine or stringer tubes arranged horizontally or vertically back and forth within the economizer 3. The tubes in one tubular configuration may be positioned in an offset relationship with respect to the tubes of the other tubular configuration. The tubes may be offset vertically, horizontally, diagonally, or longitudinally or offset in a combination of two or more such orientations. Preferably, the tubular configurations 1, 2 are positioned adjacent to one another in the convection pass 13 in an overlapping or non-overlapping relationship, and extend or expand substantially along a flow path 14 of the flue gas passing across the economizer 3. In an alternate embodiment, the heat transfer capacity of each tubular configuration is not identical. It will also be appreciated that the tubes forming the tubular configurations 1, 2 may or may not employ extended surface such as fins to achieve a desired amount of heat transfer to the feedwater flowing through the economizer 3.

An existing economizer 3 can be modified or retrofitted according to the present invention, such that a selected tubular configuration is fed with sufficient feedwater to effectively reduce the overall heat transfer capacity of the economizer 3. The remaining feedwater is circulated into the remaining tubes in the other tubular configuration. The tubes in the selected tubular configuration would receive more than the normal flow which will slightly increase the heat transfer of this tubular configuration. Also, by determining the appropriate quantity of tubes for each tubular configuration or economizer bank, the effective heat transfer of the economizer 3 can be reduced so that the desired economizer outlet gas temperature is obtained. In FIG. 1, the stringer tubes S that are used to support convective superheat heat transfer surface (not shown; located above the economizer 3) are shown. In most cases, these stringer tubes S will require the full flow from the economizer 3 because the gas temperatures increase in the upper regions of the convection pass and the need for cooling would be greater for these stringer tubes S to meet the stress requirement for supporting these additional heat transfer surfaces.

The temperature monitoring required to adjust the proportioning values of the system can be monitored by knowing the outlet gas temperature or by knowing the inlet gas temperature along with the water side temperatures, both inlet and outlet, and the water side fluid flow through the system. Preferably, temperature and flow rate monitoring, and adjustment of the flow rate in each tubular configuration or economizer bank are carried out by a controller 9.

In operation, temperature sensors are provided at the flue inlet and/or at the flue outlet 4, at the feedwater inlet and at the feedwater outlet. A flow meter (not shown) is also provided for the main feedwater line to measure the economizer 3 fluid flow through the system. The temperature sensors and flow meter are in signal communication 10 with controller 9 and are calibrated to transmit measurements to the controller 9 for the feedback control of the flow of feedwater through each tubular configuration 1, 2.

For example, when the controller 9 detects a drop in the boiler load or in the gas temperature at the economizer flue inlet or outlet, the flow of feedwater through each tubular configuration is adjusted to reduce the combined heat transfer capacity of the economizer. This can be achieved by increasing the flow of feedwater through one tubular configuration to decrease the flow and heat transfer of the other tubular configuration.

Figure 2:
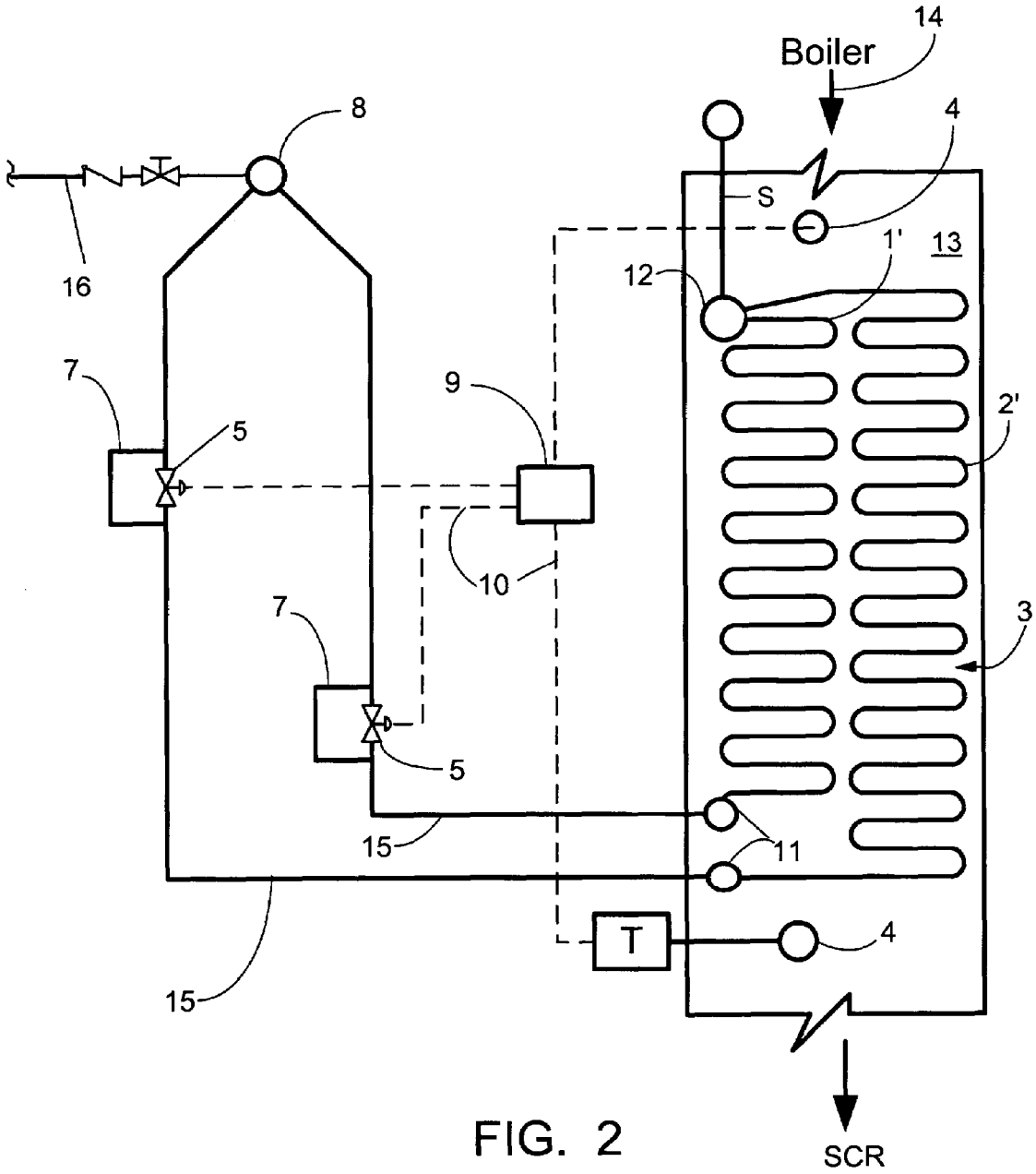
FIG. 2 is a schematic of an embodiment of the present invention showing two tubular configurations positioned adjacent one another in a non-overlapping relationship.

FIG. 2 shows the tubular configurations in the economizer positioned adjacent one another in a non-overlapping relationship. The heat transfer of the overall economizer system can be reduced and the desired outlet gas temperature can be obtained by changing the flow rates in the adjacent tubular configurations 1', 2'. In both embodiments, the two different water pathways through the economizer have two different heat transfer characteristics. For example the tube or pathway 1' in FIG. 2 is shorter than the tube 2'. In the embodiment of FIG. 1, the tubes may have different heat transfer characteristic due to different surface treatments of the tubes, different diameters of the tubes, different placement in the gas flow path or different lengths.

Figure 3:
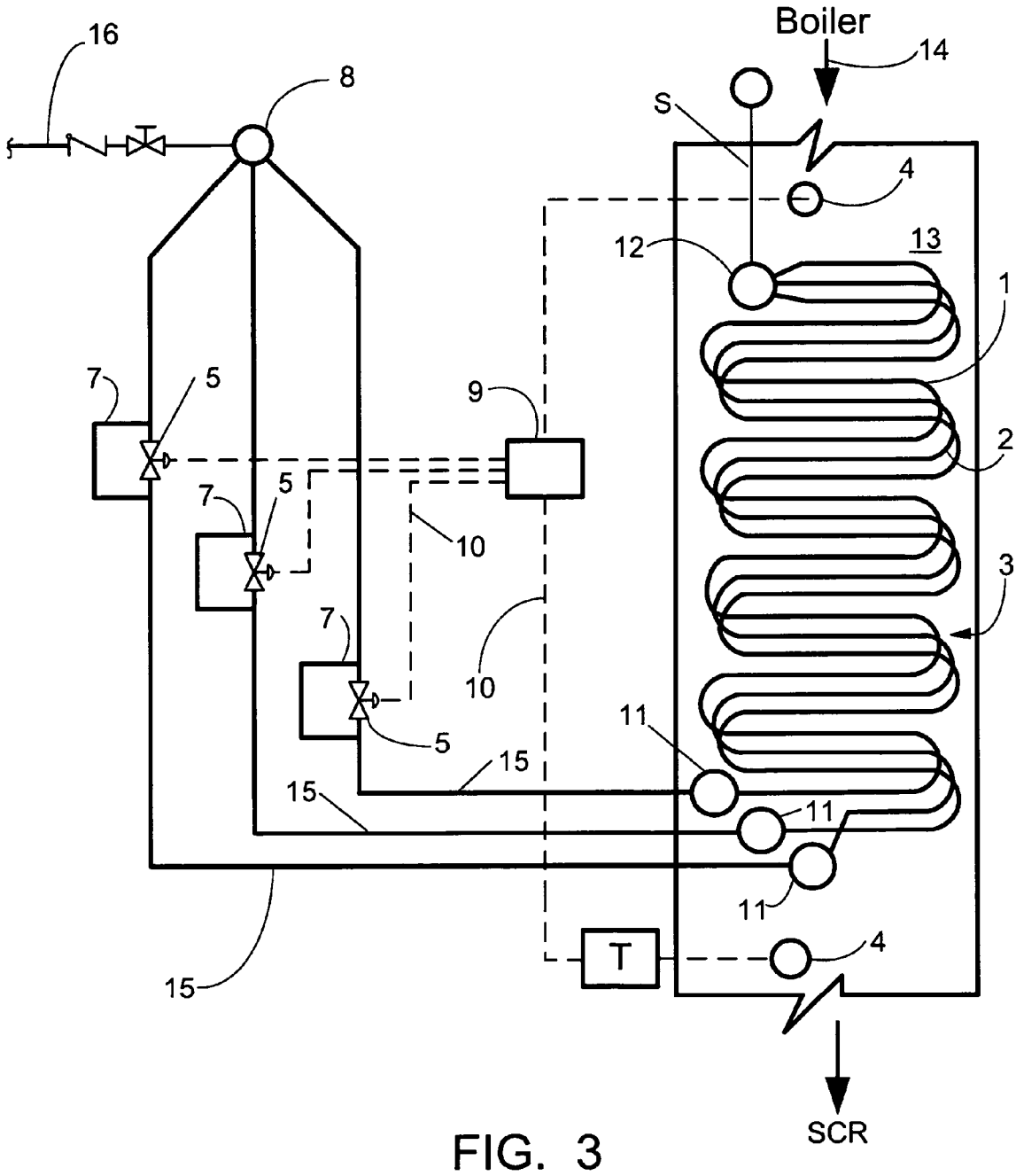
FIG. 3 is a schematic of an embodiment of the present invention showing three tubular configurations positioned adjacent one another in a non-overlapping relationship.

FIG. 3 is a schematic of an embodiment of the present invention showing three tubular configurations positioned adjacent one another in a non-overlapping relationship, and is otherwise similar in concept and operation to FIG. 2. This concept may be particularly useful for controlling gas temperature to prevent it from falling below the acid dew point temperature at which condensation may begin to occur, reducing the possibility of condensation occurring which could form acidic compounds that can corrode downstream devices such as air heaters. Again, while each feedwater line 15 may also include a bypass line 7 installed around its associated control valve 5 for cleaning or flushing the feedwater lines 15 or the tubular configurations 1, 2, or for performing maintenance on the control valve 5, it will be appreciated that a control valve 5, bypass line 7 "pair" does not need to be installed in each feedwater line 15; in a three tubular configuration arrangement, a control valve 5, bypass line 7 pair need only be supplied on two of the three tubular configurations. This arrangement may again be particularly useful at lower boiler loads, depending upon the degree of control desired.

In addition, under certain low flow conditions, it may be necessary to provide orifice means at one or both of the inlets and outlets of individual tubes in a given tubular configuration to provide additional pressure drop for flow stability in these tubes. Orificing these tubes, particularly the lower velocity flow paths, provides additional pressure drop which will tend to equalize the flow distribution between each of the tubes in that tubular configuration.

Figure 4:
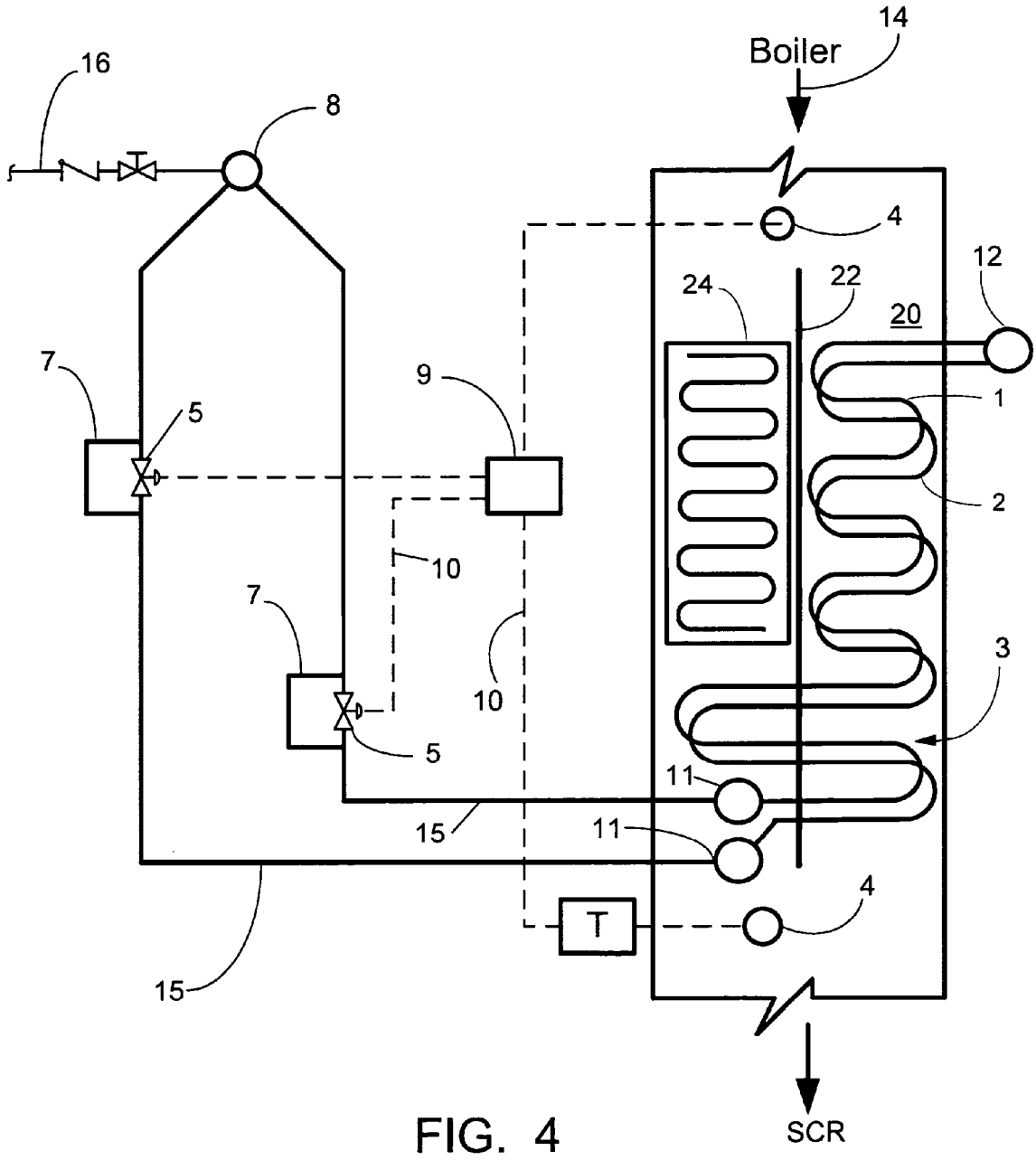
FIG. 4 is a schematic of an embodiment of the present invention showing application of the invention to a parallel gas path convection pass design.

FIG. 4 illustrates application of the principles of the present invention to a parallel gas path convection pass design. The parallel gas paths in the convection pass 20 are established by a baffle 22 as is known to those skilled in the art. As shown therein, the economizer 3 may have a lower portion which extends across both of the parallel gas paths, while an upper portion may reside only in a single one of the parallel gas paths. Opposite the upper portion of the economizer 3, in the other gas path, may be provided steam cooled surface, such as superheater or reheater surface 24. The baffle 22 may or may not extend into the lower portion of the economizer 3, and may be steam or water cooled surface depending upon the flue gas temperatures.

Figure 5:
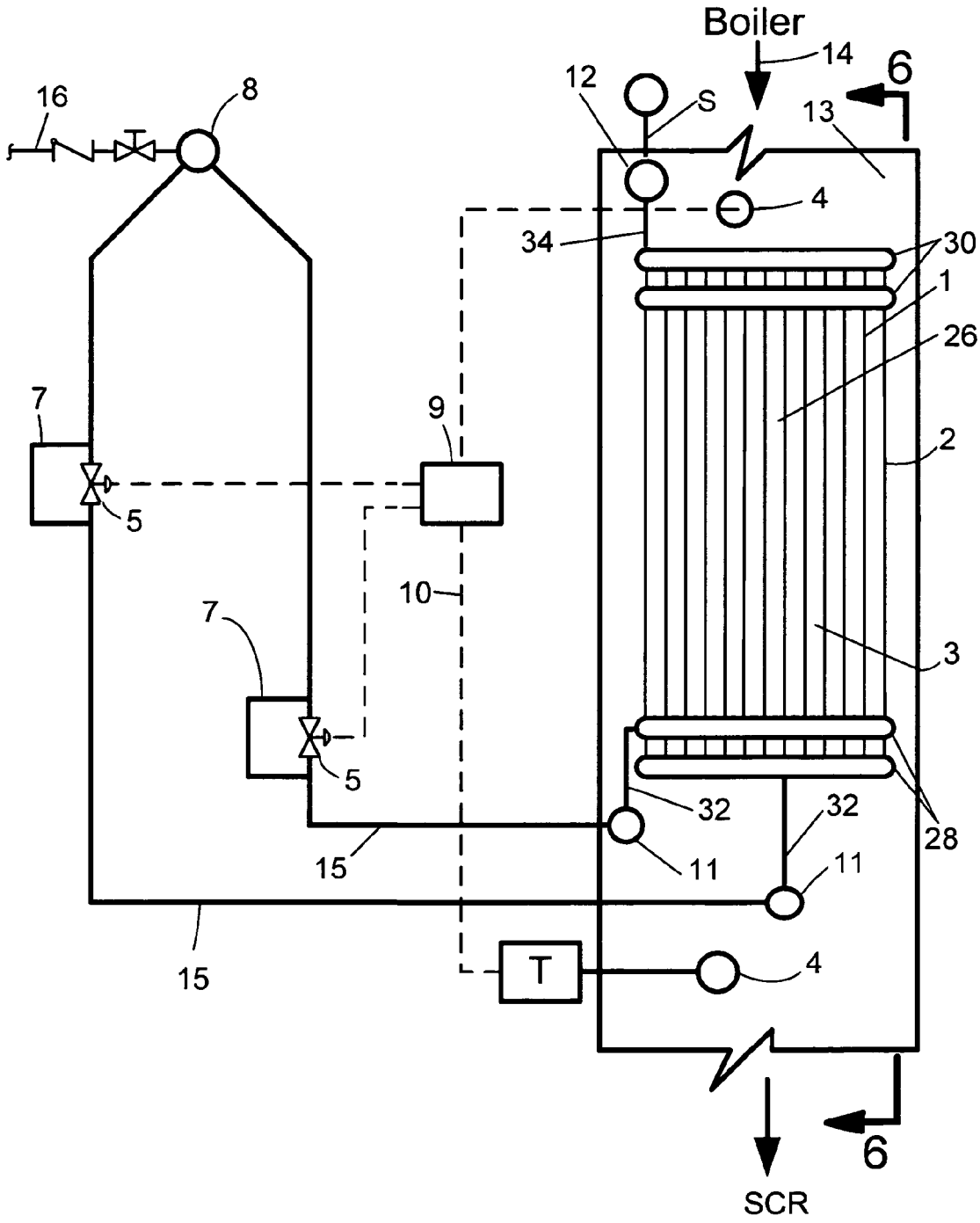
FIG. 5 is a schematic of an embodiment of the present invention showing application of the invention to a longitudinal flow economizer, where the concept is applied to control the flow to individual panels of tubes forming the economizer.
Figure 6:
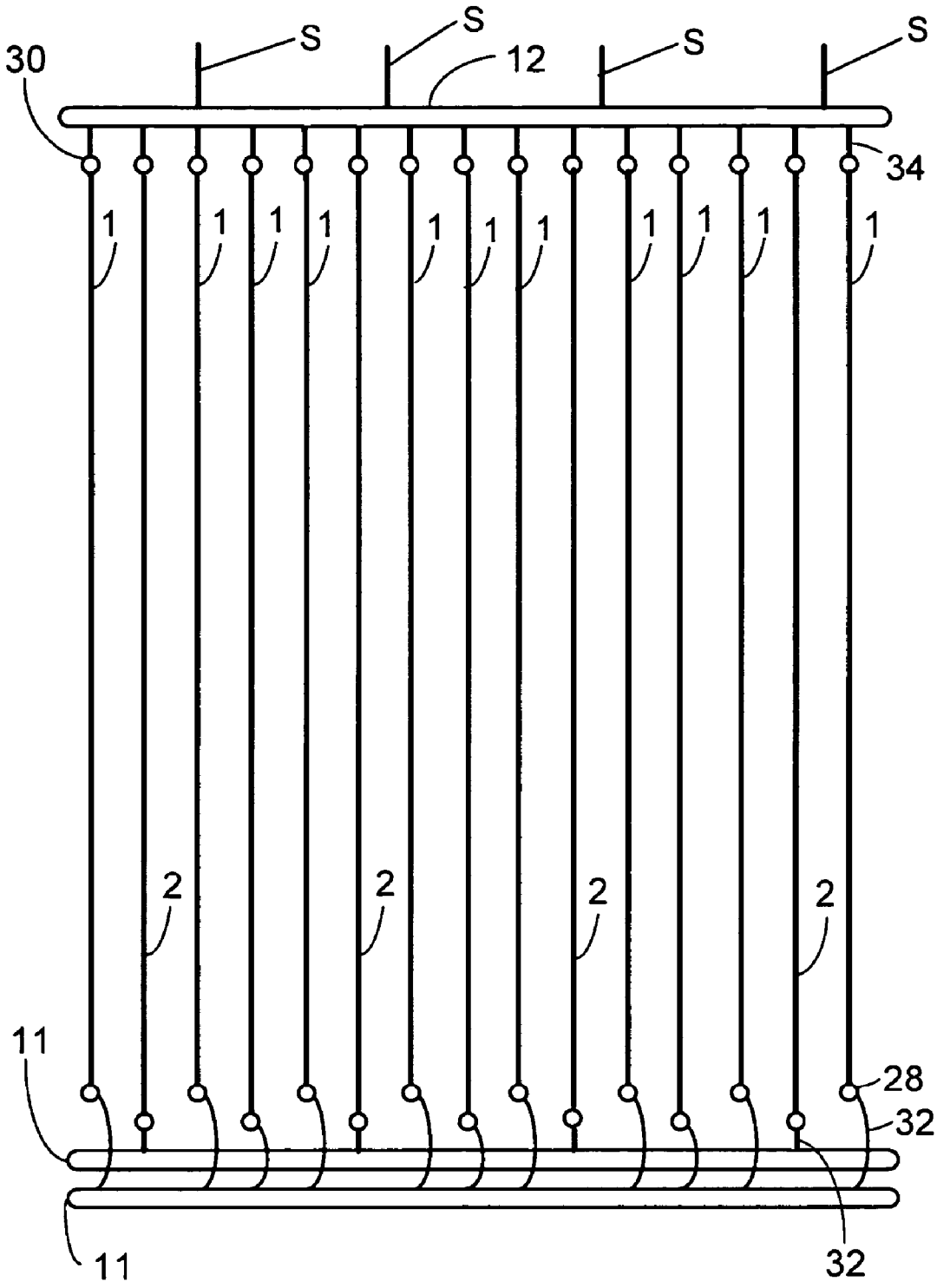
FIG. 6 is a schematic rear view looking into the convection pass of FIG. 5.

FIGS. 5 and 6 are drawn to an embodiment of the present invention as applied to a longitudinal flow economizer, where the concept is applied to control the flow to individual panels 26 of tubes forming the economizer 3. The individual panels 26 of tubes are provided with panel inlet headers 28 and panel outlet headers 30. Feedwater from the economizer inlet headers 11 are fed to the panel inlet headers 28 by means of supply tubes 32. Feedwater flow through the panels 26 and is collected at the panel outlet headers 30. Feedwater is then conveyed from the panel outlet headers 30 via riser tubes 34 to the economizer outlet header 12.

FIG. 6 is a schematic rear view looking into the convection pass of FIG. 5, viewed in the direction of arrows 6-6 of FIG. 5. It is understood that while two tubular panel configurations 1, 2 are shown, an additional third tubular panel configuration flow path could be employed as well.

Figure 7:
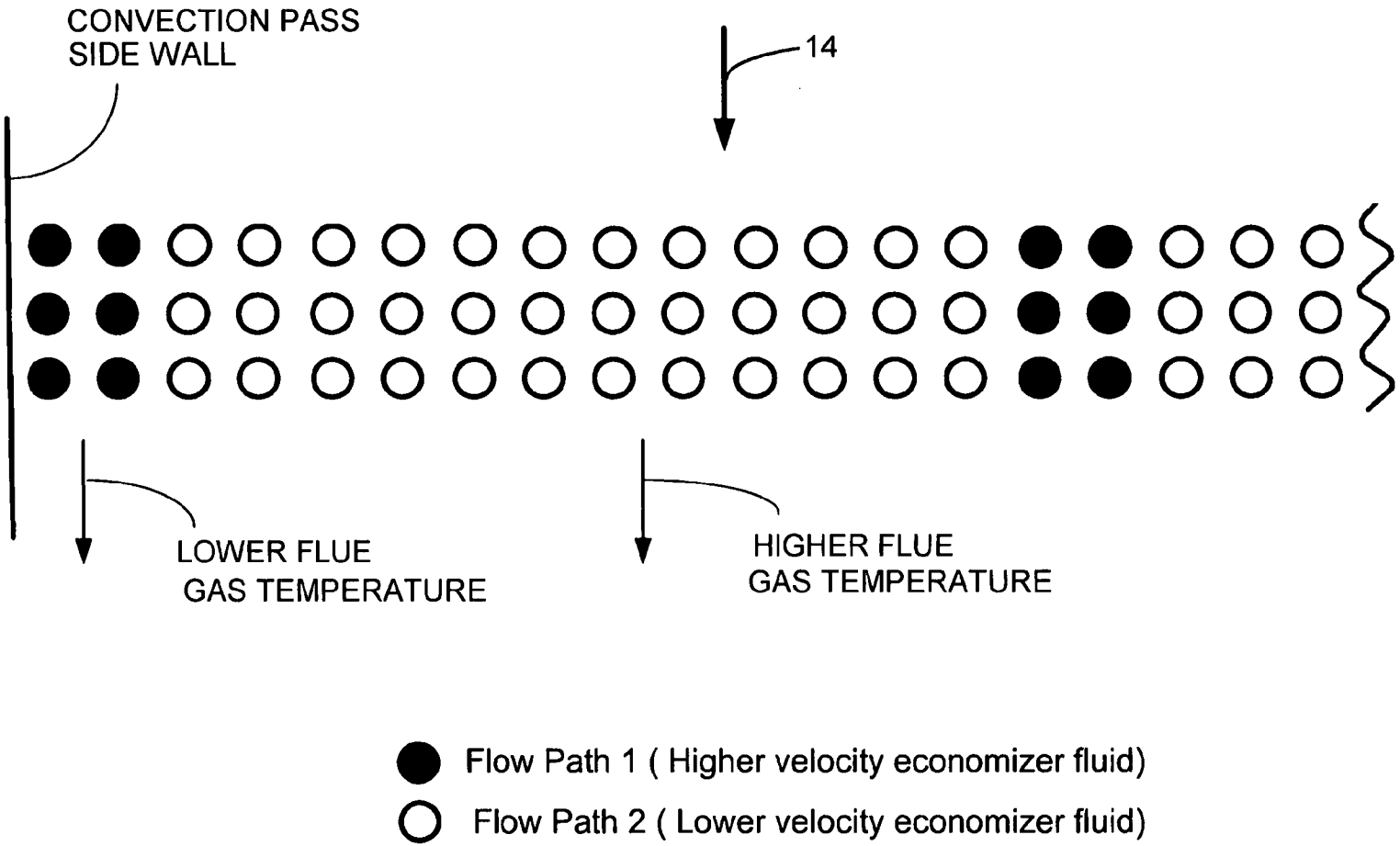
FIG. 7 is a schematic view illustrating a partial rear view of the tubes in the serpentine arrangement of FIG. 1 to show the variations in fluid flow and flue gas temperature resulting therefrom.

FIG. 7 is a schematic view illustrating a partial rear view of the tubes in the serpentine arrangement of FIG. 1 to show the variations in fluid flow and flue gas temperature resulting therefrom. The tubes comprising flow path 1 (higher velocity economizer fluid) are denoted by solid dark circles, while the tubes comprising flow path 2 (lower velocity economizer fluid) are denoted by open circles. The higher velocity economizer fluid tubes extract more heat from the flue gas passing across these tubes, and as a result the flue gas temperature leaving these banks of tubes is lower than the flue gas temperature leaving those banks of tubes which have a lower economizer fluid flow therethrough.

Figure 8:
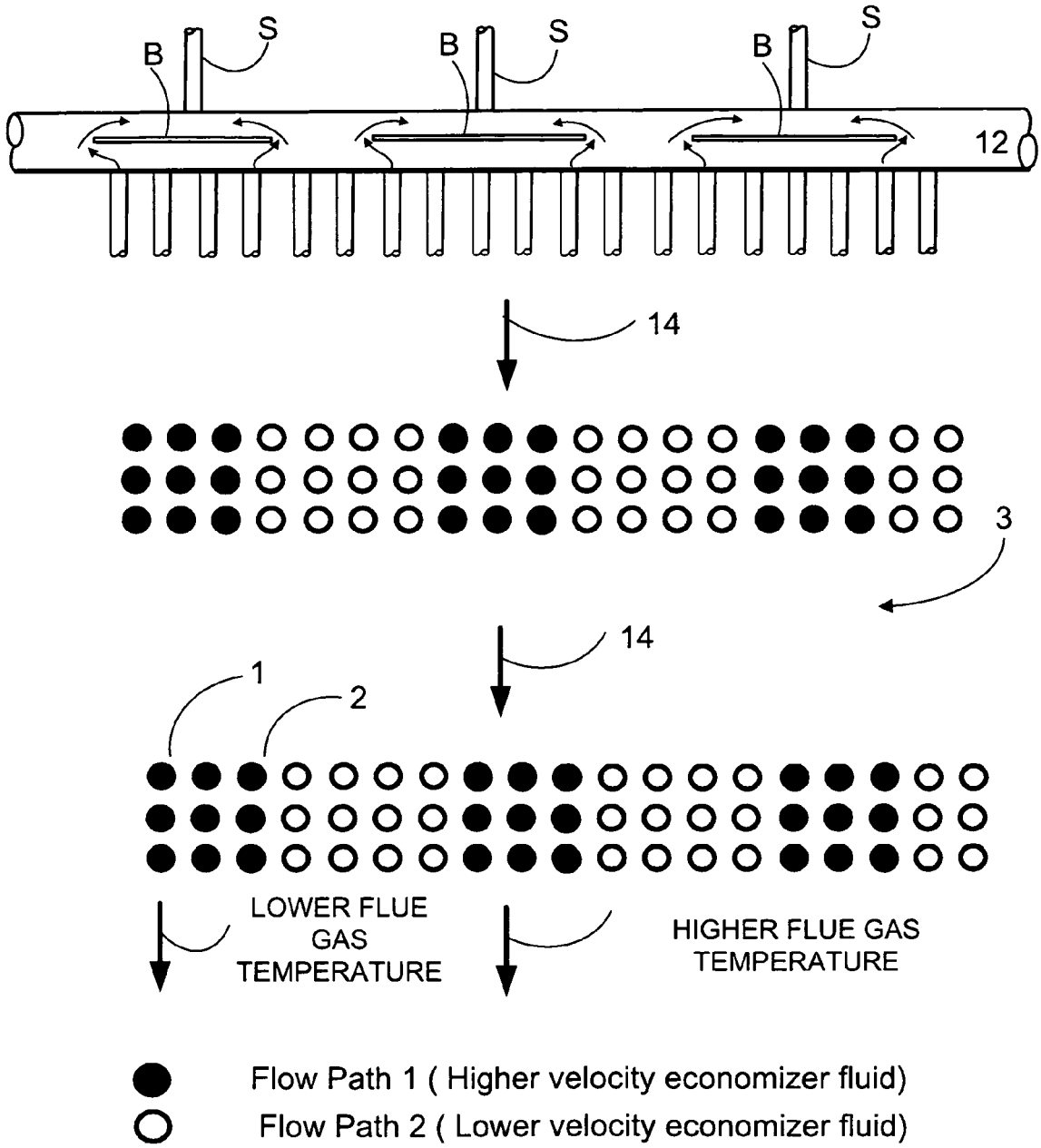
FIGS. 8 and 9 are schematic views illustrating a partial rear view of the tubes in a serpentine arrangement similar to that shown in FIG. 1 to show how variations in economizer outlet fluid temperature due to the variations in fluid flow and flue gas temperature can be accommodated in the outlet headers and supporting stringer tubes.
Figure 9:
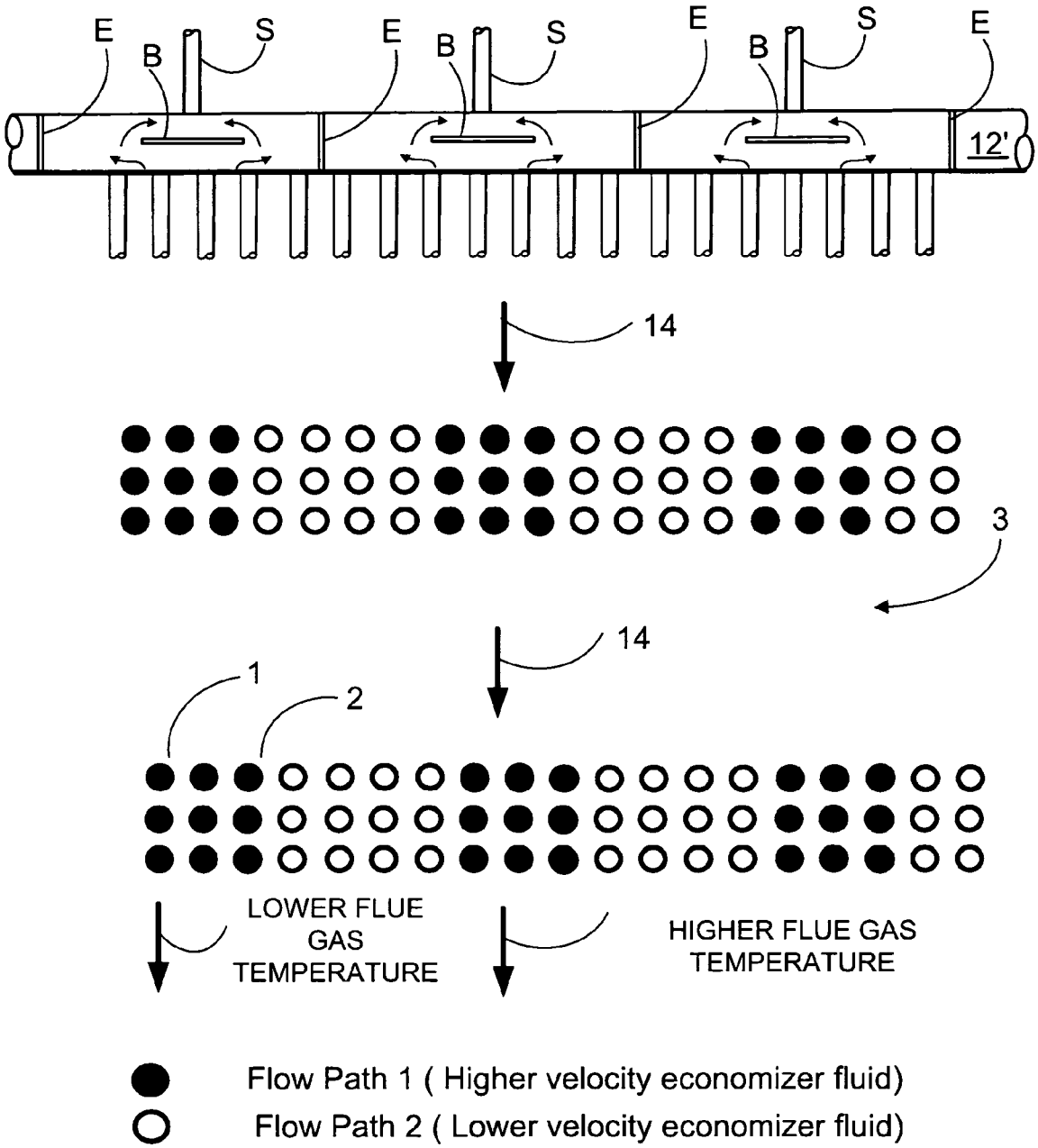

FIGS. 8 and 9 are schematic views illustrating a partial rear view of the tubes in a serpentine arrangement similar to that shown in FIG. 1 to show how the variations in economizer 3 outlet fluid temperatures due to the variations in fluid flow and flue gas temperature can be accommodated in outlet headers 12, 12' and supporting stringer tubes S. As before, the tubes comprising flow path 1 (higher velocity economizer fluid) are denoted by solid dark circles, while the tubes comprising flow path 2 (lower velocity economizer fluid) are denoted by open circles. In some economizer arrangements, the economizer outlet header may be a continuous header 12, with a single common interior portion, where feedwater heated by the various tubular configurations in the economizer 3 is collected and then dispersed via the stringer tubes S. While theoretically the economizer feedwater may travel anywhere along the length of this outlet header 12, in practice the feedwater travels the shortest route from the tubular configurations feeding the outlet header 12 into the nearest adjacent stringer tubes S. This type of economizer outlet header is schematically illustrated in FIG. 8. In other types of economizer arrangements, the economizer outlet header may be formed of a plurality of separate, shorter headers which are then field girth welded together at their ends E to make the entire economizer outlet header. In this type of economizer outlet header, designated 12' and schematically illustrated in FIG. 9, the feedwater can only be conveyed into and out of the interior portions of each separate header, the ends E of each header preventing fluid flow into adjacent separate headers. It will thus be appreciated that fewer tubular configurations supply feedwater to these separate headers and fewer stringer support tubes S convey feedwater from these separate headers. Significant temperature differences between the temperature of the fluid within the stringer tubes S are to be avoided since such temperature differences can lead to differential thermal expansion of the stringer tubes S. In order to encourage mixing of the hotter and cooler feedwater fluids entering either type of economizer header 12 or 12', a baffle means B may be employed to encourage mixing of the hotter and cooler feedwater streams within the headers 12, 12' prior to the feedwater exiting into the stringer support tubes S, thereby equalizing the temperatures within the stringer tubes S. The baffle means B may be a simple plate located to cause the feedwater flow to divert as desired, or it may be a more complex structure such as a perforated plate with holes sized and/or spaced in a particular configuration.

While two types of economizer outlet headers 12, 12' are shown in FIGS. 8 and 9 it will be appreciated that only one type of economizer outlet header, 12 or 12', would typically be employed for an economizer in a given steam generator. Similarly, while the earlier Figs. have employed the reference numeral 12 for the outlet header, it will be appreciated that either type of header 12 or 12' may be employed in all of these embodiments.

As discussed earlier, the present invention is particularly suited to maintaining a desired flue gas temperature entering a downstream SCR device. However, it will be appreciated that the invention may be used to maintain a desired gas temperature which may required by other types of downstream devices, and for other purposes. One type of downstream device could be an air heater which typically uses the heat in the flue gas leaving the steam generator to heat the incoming air for combustion. In some cases it is desirable to control the flue gas temperature entering the air heater within a desired range or at a desired temperature above the acid dew point temperature, such as during low load operation, to reduce the possibility of condensation occurring which could form acidic compounds which could lead to corrosion of the air heater. Other types of downstream devices include various types of pollution control equipment; e.g., particulate removal devices such as electrostatic precipitators or fabric filters, and flue gas desulfurization devices such as wet or dry flue gas desulfurization equipment.

While specific embodiments of the invention have been shown and described in detail to illustrate the application of the principles of the invention, it will be understood that the invention may be embodied otherwise without departing from such principles. For example, the present invention may be applied to new boiler or steam generator construction involving selective catalytic reactors or other types of downstream devices, or to the replacement, repair or modification of existing boilers or steam generators where selective catalytic reactors or other types of downstream devices and related equipment are or have been installed as a retrofit. In some embodiments of the invention, certain features of the invention may sometimes be used to advantage without a corresponding use of the other features. Accordingly, all such changes and embodiments properly fall within the scope of the following claims.

What is claimed is:

1. A system for sourcing a heated flue gas stream, directing the gas stream through a downstream device and maintaining the gas stream entering the device within a desired temperature range or at a desired temperature, comprising:

an economizer located upstream gas flow-wise of the device, the economizer having a flue gas inlet and a flue gas outlet and at least two tubular configurations disposed in a cross and/or counter-current heat exchange relationship with the flow path of the flue gas stream, the heated flue gas source being located upstream gas flow-wise of the economizer, each tubular configuration having a feedwater inlet and a feedwater outlet, the outlet of both tubular configurations being attached to a separate or common outlet header and the inlet of each tubular configuration being attached to a separate inlet header, a control system configured to independently control the flow of feedwater through each tubular configuration while maintaining a substantially constant total flow of feedwater through the economizer, and wherein the flow of feedwater through each tubular configuration is adjusted in a manner that transfers an appropriate amount of heat from the gas stream to maintain the gas stream entering the device within the desired temperature range or at the desired temperature.

2. The system of claim 1, wherein each tubular configuration comprises a plurality of serpentine tubes arranged horizontally or vertically back and forth within the economizer.

3. The system of claim 2, wherein the back and forth arrangement of the tubes is offset in a longitudinal, vertical, diagonal, or horizontal axis or direction of the economizer, or the arrangement is offset in a combination of such orientations.

4. The system of claim 1, wherein the amount of heat transferred from the gas stream is decreased by increasing the flow of feedwater through at least one of the tubular configurations and by reducing the flow of feedwater through the remaining tubular configurations, wherein the total flow of feedwater through the economizer is maintained substantially constant.

5. The system of claim 1, wherein the flow path of the gas stream is cross and/or co-current with the flow of the feedwater.

6. The system of claim 2, wherein the back and forth arrangement of the tubes extends or expands in a longitudinal axis or direction of the economizer.

7. The system of claim 1, further comprising:

a first temperature sensor mounted about the flue gas inlet and/or outlet of the economizer for measuring the inlet and outlet gas temperature;

a flow meter for measuring the flow of feedwater through the tubular configurations;

a second temperature sensor for measuring the feedwater temperature at the inlet and outlet of the tubular configurations; and a plurality of control valves for adjusting the flow of the feedwater through the tubular configurations, wherein the first and second temperature sensor, the flow meter, and the control valves are in signal communication with the control system.

8. The system of claim 7, wherein the first and second temperature sensor, and flow meter are positioned and calibrated to provide the control system with the appropriate measurements for adjusting the heat transfer rate of the economizer.

9. The system of claim 8, wherein the heat transfer rate of the economizer is adjusted by a method, comprising the steps of:

selecting the appropriate tubular configuration; and controlling the flow rate of the feedwater flowing through the selected tubular configuration.

10. The system of claim 1, wherein the heated flue gas source is a boiler.

11. The system of claim 1, wherein maintaining the desired optimal temperature does not require having heated flue gas bypassing the economizer.

12. The system of claim 2, wherein the tubular configurations are positioned adjacent to each other in a side-by-side non-overlapping relationship.

13. The system of claim 1, wherein each tubular configuration is provided with a different heat transfer capacity.

14. The system of claim 1, wherein the tubular configurations have different heat transfer characteristics from each other.

15. The system of claim 1, wherein the outlet header is provided with baffle means for encouraging mixing of feedwater from the tubular configurations prior to the feedwater exiting from the outlet header.

16. The system of claim 1, wherein at least one of the tubular configurations is provided with orifice means at one or both of the inlet and outlet of individual tubes to provide additional pressure drop to equalize flow distribution between each of the tubes in that tubular configuration.

17. The system of claim 1, wherein the downstream device comprises at least one of an SCR assembly, an air heater, particulate removal devices, and flue gas desulfurization devices.

18. A method of sourcing a heated flue gas stream, directing the gas stream through a downstream device and maintaining the gas stream entering the device within a desired temperature range or at a desired temperature, the downstream device being located downstream gas flow-wise of an economizer, the method comprising:

disposing, within the economizer, at least two tubular configurations in a cross and/or counter-current heat exchange relationship with the flow path of the gas stream, the economizer having a flue gas inlet and a flue gas outlet, each tubular configuration having a feedwater inlet and a feedwater outlet, the outlet of both tubular configurations being attached to a separate or common outlet header and the inlet of each tubular configuration being attached to a separate inlet header, monitoring the gas temperature at the flue gas inlet or flue gas outlet, the feedwater temperature at the feedwater inlet and outlet, and the flow of feedwater through the economizer, and controlling the flow of feedwater conveyed through each tubular configuration, based on the measured temperatures and flow, to provide the tubular configurations with a combined heat transfer capacity that is effective to maintain the gas temperature within the desired temperature range or at the desired temperature, and wherein the heat transfer capacity of the tubular configurations is decreased by increasing the flow of feedwater through at least one of the tubular configurations and by reducing the flow of feedwater through the other tubular configurations.

19. The method of claim 18, wherein each tubular configuration comprises a plurality of serpentine tubes arranged horizontally or vertically back and forth within the economizer.

20. The method of claim 19, wherein the back and forth arrangement of the tubes is offset in a longitudinal, vertical, diagonal, or horizontal axis or direction of the economizer, or the arrangement is offset in a combination of such orientations.

21. The method of claim 18, wherein the flow path of the gas stream is cross and/or co-current with the flow of the feedwater.

22. The method of claim 19, wherein the back and forth arrangement of the tubes extends or expands in a longitudinal axis or direction of the economizer.

23. The method of claim 19, wherein the tubular configurations are positioned adjacent to each other in a side-by-side non-overlapping relationship.

24. The method of claim 18, wherein each tubular configuration is provided with a different heat transfer capacity.

25. The method of claim 18, wherein the tubular configurations have different heat transfer characteristics from each other.

26. The method of claim 18, comprising directing the flue gas stream into a downstream device which includes at least one of an SCR assembly, an air heater, particulate removal devices, and flue gas desulfurization devices.

27. The system of claim 10, wherein the control system is configured to maintain the desired optimal temperature irrespective of changes in the boiler load or in the temperature of the gas stream.

28. The system of claim 1, wherein maintaining the desired optimal temperature does not require having feedwater bypassing the economizer.

29. The method of claim 18, wherein maintaining the desired optimal temperature does not require the bypassing of feedwater around the economizer.

* * * * *